United States Patent [19]

Peck

[11] 4,295,392

[45] Oct. 20, 1981

[54] CORKED BOTTLE OPENER

[76] Inventor: Wallace C. Peck, 227 Grove St., Norwell, Mass. 02061

[21] Appl. No.: 50,991

[22] Filed: Jun. 22, 1979

[51] Int. Cl.[3] ..... B67B 7/04; B67B 7/36

[52] U.S. Cl. ..... 81/3.32; 81/3.38 A; 81/3.45

[58] Field of Search ..... 81/3.31, 3.32, 3.3 R, 81/3.38 R, 3.38 A, 3.45

[56] References Cited

U.S. PATENT DOCUMENTS

| | | | |
|---|---|---|---|
| 280,697 | 7/1883 | White | 81/3.38 A |
| 308,686 | 12/1884 | Merrill | 81/3.32 |
| 926,112 | 6/1909 | Gould | 81/3.32 |
| 1,091,301 | 3/1914 | Doheny | 81/3.3 R |
| 1,340,551 | 5/1920 | Madsen | 81/3.32 |
| 3,158,879 | 12/1964 | Barrett | 81/3.32 |

FOREIGN PATENT DOCUMENTS

| | | | |
|---|---|---|---|
| 7761 | of 1938 | United Kingdom | 81/3.38 R |

*Primary Examiner*—Roscoe V. Parker
*Attorney, Agent, or Firm*—Wolf, Greenfield & Sacks

[57] ABSTRACT

A corked bottle opener having a base upon which a bottle is positioned, a retaining bracket with a slotted cylindrical sleeve to support the neck of a bottle and a cork removal bracket. The cork removal bracket has a pivotal corkscrew mechanism in proper vertical alignment with the corked end of the bottle. After insertion of the corkscrew into the cork, the cork removal bracket, which is pivotally secured to a vertical surface at one end, is moved upward at the other end causing the cork to be removed from the bottle with minimum effort.

4 Claims, 3 Drawing Figures

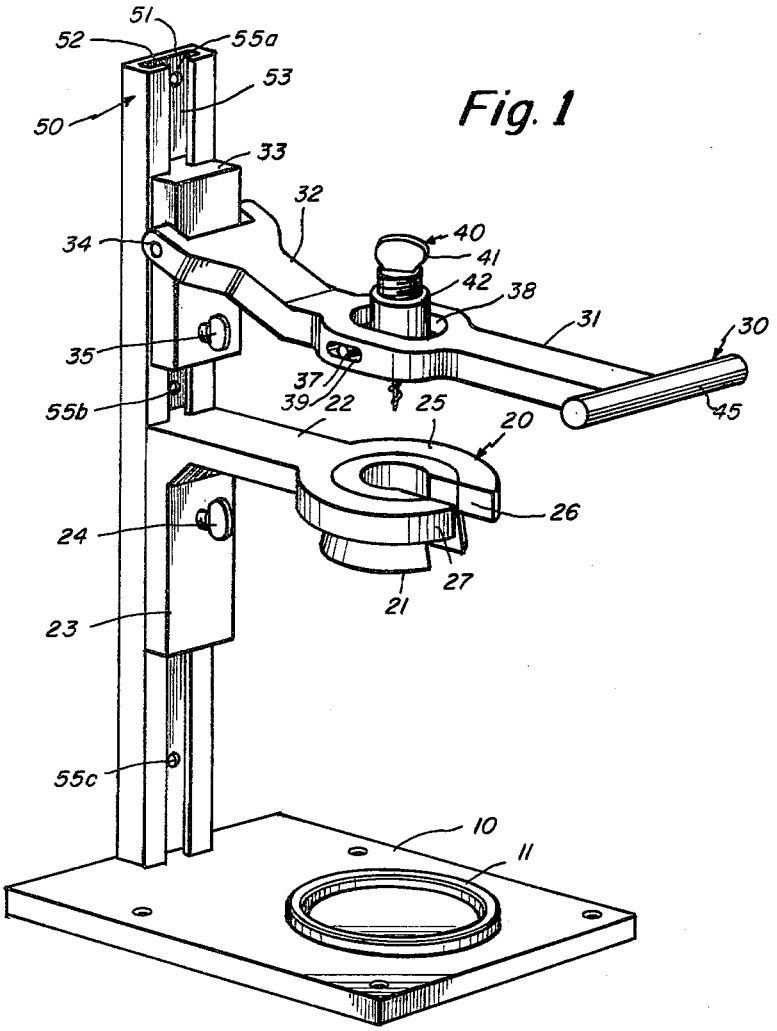
Fig. 1
Fig. 3
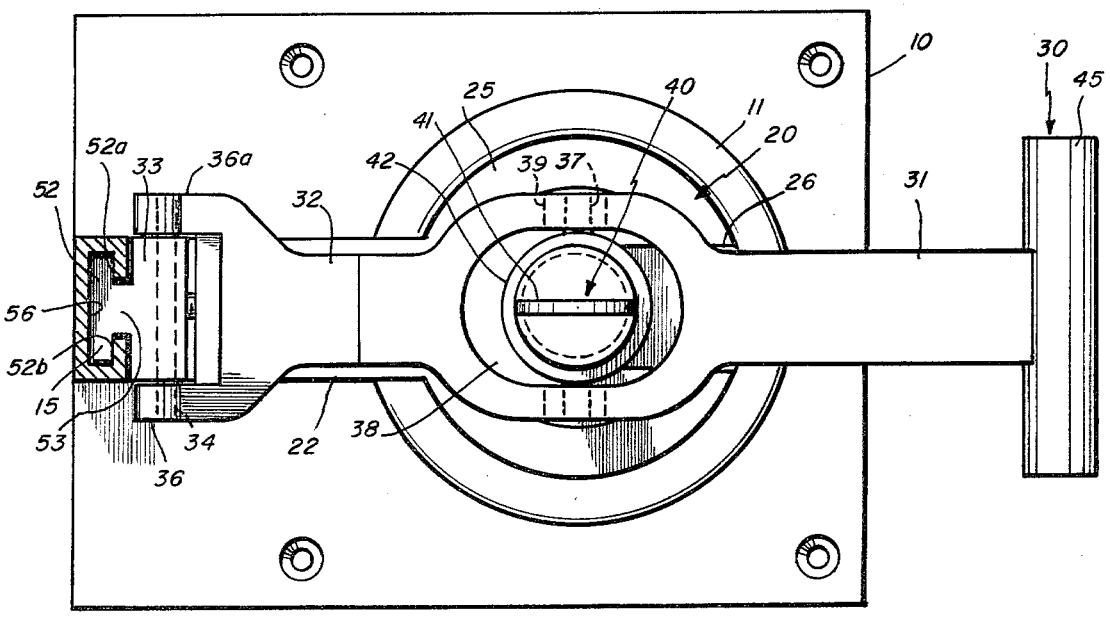

3
3
51
55a
33
34
36
32
41
40
43
42
48
49
38
37
39
30
31
45
65
47
46
60
44
29
63
63a
35
55b
53
52
22
20
26
29a
21
56
24
23
28
55c
29b
11
10

CORKED BOTTLE OPENER

BACKGROUND OF THE INVENTION

1. Field of the Invention

The present invention relates to a wine bottle opening device. More specifically, the invention relates to a fixed device designed to remove a cork from a bottle.

2. Description of Prior Art

In recent years, the consumption of wine in this country has increased dramatically. Americans are purchasing more wine for home use and, more significantly, are ordering wines when they dine out. As a result, many more restaurants are providing wines with their bill of fare.

Traditionally, a bottle of wine was opened at the restaurant guests' table by a wine maitre'd. The huge increases in purchases of wine at less prestigious restaurants has required ordinary waitresses to open bottles at the guests' tables. Due to the difficulty of removing a cork from a wine bottle and the necessary expenditure of time, many restaurants have found it more efficient to open the bottles in the kitchen. The bottles are ordinarily opened in the kitchen or at the service bar by someone stronger than the ordinary waitress.

The devices used in the kitchen are often the same corkscrew device that a waitress would use at the guests' table. Basically, the device requires the insertion of a corkscrew into the upper surface of the wine bottle cork, and then, by use of manual labor, the pulling of the cork out of the bottle. Due to an uneven insertion of the corkscrew and resultant force applied to the cork, pieces of cork are separated from the main body and drop into the wine. Sometimes a portion of the cork can remain in the bottle while the upper portion is removed.

There is thus a need to provide a corked bottle opener which eliminates the excessive manual force presently needed. There is also need for a device which can quickly and efficiently position a corkscrew so that it can accurately enter a cork and remove it with minimum effort.

BRIEF DESCRIPTION OF THE INVENTION

The present invention is a corked bottle opener which can be used with greater efficiency than the prior art. The opener requires less effort than a typical corkscrew device in addition to removing the cork with less chance of error. The present device consists of an L-shaped support structure whose lower surface is a base, and perpendicular thereto is a bracket support structure. Extending from the vertical bracket support structure in a direction substantially parallel to the base are the retaining bracket and corkscrew bracket.

The retaining bracket is positioned beneath the corkscrew bracket and is designed to be contiguous with the neck of a typical corked bottle. A sleeve at the distant end of the retaining bracket holds and aligns the bottle so that the cork is properly positioned for removal.

The cork removal bracket contains a corkscrew mechanism which is positioned directly above the cork. The corkscrew mechanism is screwed into the cork and the entire bracket is manually moved upward so that the cork is lifted from the bottle. The hinging of the corkscrew bracket to a bracket support presents a second class lever system which results in minimum manual effort.

The precise cork alignment, corkscrew insertion and minimum manual effort results in a cork removal device that is highly suitable for commercial use.

Further features and characteristics of the present invention can be seen from the figures and descriptions below.

BRIEF DESCRIPTION OF THE DRAWINGS

FIG. 1 is a perspective view of the corked bottle opener of the present invention.

FIG. 3 is a top view of the corked bottle opener along line 3—3 of FIG. 2.

DETAILED DESCRIPTION OF THE INVENTION

Figure 2:
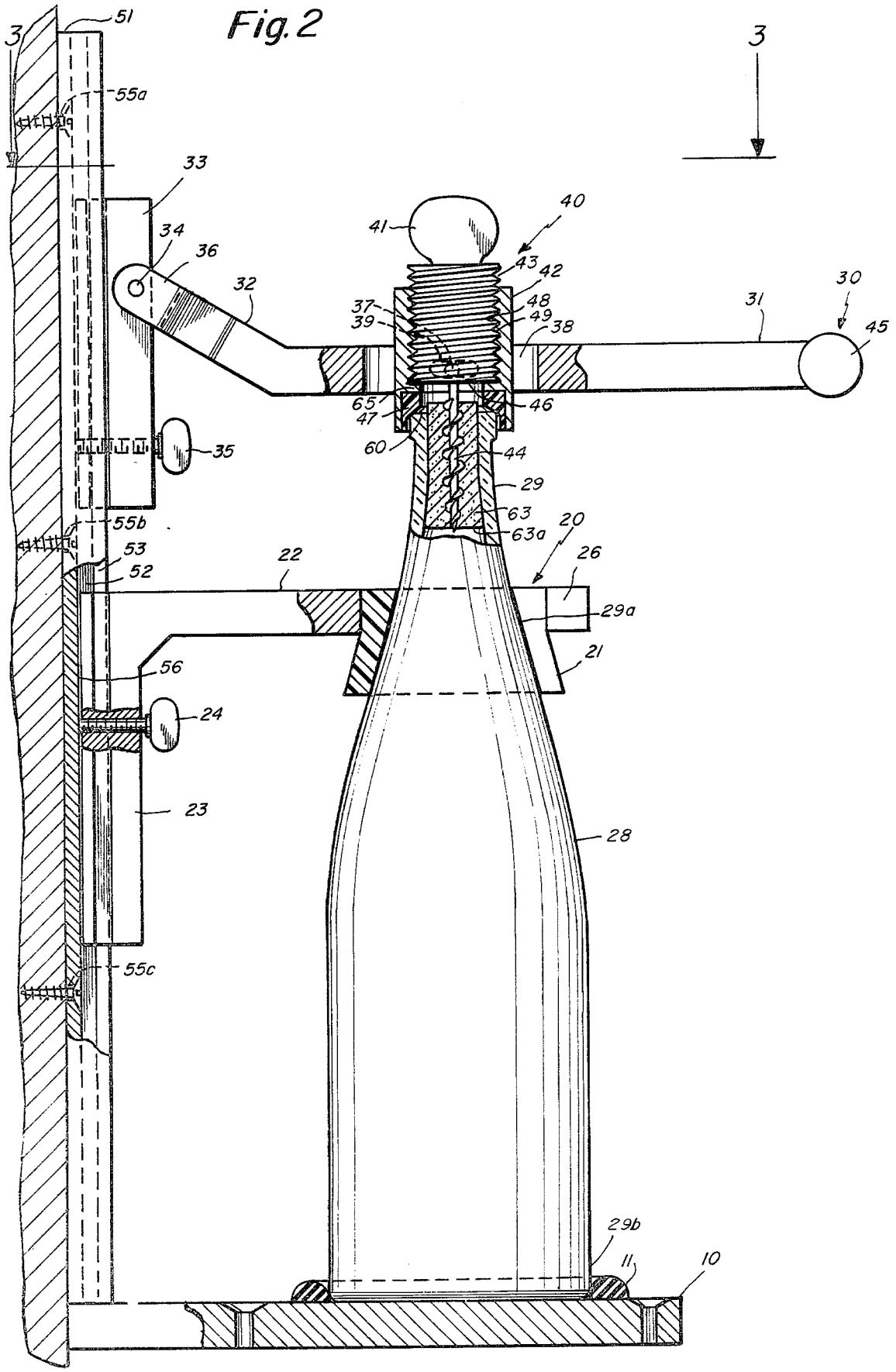
FIG. 2 is a side elevation, partially sectioned, of the corked bottle opener of FIG. 1.

The present invention shown perspectively in FIG. 1 has a rectangular base plate 10 with a bottle retaining ridge 11. Attached perpendicular to base plate 10 is a bracket support column 50. The bracket support 50 is attached to base plate 10 by conventional techniques. If desired, the bracket support 50 and base plate 10 can be integral and further, bracket support 50 can be as wide as base plate 10 for aesthetic reasons.

Mounted on bracket support 50 are corkscrew bracket assembly 30 and rectangular bracket assembly 20. To accommodate both brackets, bracket support 50 contains a T-shaped slot 51 extending along the entire height of the device. As can be seen in FIGS. 1 and 3, slot 51 consists of an elongated portion 52 and narrower inlet portion 53 to accommodate mating bracket mounts 23 and 33. As weight is applied to bracket mounts 23 and 33, the configuration of the T-slot 51 prevent the mounts from separating from bracket support 50. To provide additional structural support to the device, the bracket support 50 is typically secured to a wall by attaching means 55*a*, 55*b* and 55*c*.

Retaining bracket 20 comprises the mounting bracket portion 23 and a transverse arm 22 integral to the mounting bracket. Thus, arm 22 extends from the bracket support 50 so that the distant end 27 is approximately in vertical alignment with the area defined by the retaining ridge 11. At distant end 27 is positioned a retaining ring portion 25 which is adapted to receive the neck portion of a corked bottle. Inside ring portion 25 is a protective sleeve 21 which is adapted to be contiguous and provide support to a corked bottle. Typically, sleeve 21 is made of a nylon material so that it will not cause damage to the corked bottle positioned therein. As can be seen from FIG. 2, the sleeve 21 is flared outward to conform to the approximate taper of a wine bottle 28. It can be appreciated that other interchangeable sleeve configurations can be used to adapt to various bottle configurations. The sleeve 21 show in FIGS. 1 and 2 is secured to retaining ring 25 by conventional gluing techniques. Other methods can be used such as retaining rings to provide the interchangeable sleeve feature.

To enhance the ease of operation, ring 25 and sleeve 21 contain a slot 26 which is sufficiently wide to allow the neck of bottle 28 to be placed within sleeve 21. In addition, slot 26 makes it easier for the operator to remove the bottle from the sleeve 21 after the cork has been removed. In such a configuration bottle 28 is tilted outward and inserted from below into sleeve 21. After the neck 29 of bottle 28 is inserted in sleeve 21, the retaining bracket is lowered until the sleeve is in a securing position as shown in FIG. 2. To remove any unnecessary weight from the neck of bottle 28, the retaining bracket 20 is secured to bracket support 50 by a thumb screw 24 or the like. As shown in FIG. 2, thumb screw 24 is in threaded contact with mounting bracket 23 so that the thumb screw passes through the bracket 23. As the thumb screw 24 pushes off from the back wall 56, flange 15 is caused to be pressed against interior surfaces 52*a* and 52*b* into a secure pressure fit. In this way, the retaining bracket 20 is secured to and bearing upon bracket 50.

Corkscrew bracket 30 is shown positioned above retaining bracket 20 in approximately a parallel and confronting location. Mounting bracket 33 is similarly configured to a mounting bracket 23 except for hinging pin 34. As can be seen from FIG. 3, hinging pin 34 is substantially parallel to bracket support 50 and passes through mounting bracket 33 into receiving ends 36 and 37 of arm portion 32. It can be appreciated that other hinging arrangements can be used which accomplish a similar hinging movement.

Integral with arm position 32 is arm portion 31 forming an angle of 140° degrees. Pivotally positioned within arm portion 32 is the corkscrew mechanism 40. The corkscrew mechanism 40 is positioned within slot 38 which provides sufficient space for mechanism 40 to move about pin axis 37. In order to provide additional lateral movement of mechanism 40, pin 37 is mounted in a slot 39. The slots 38 and 39 are dimensional so that the mechanism 40 can tilt as corkscrew bracket 30 is raised upward during the cork removal process. Precise details of the cork removal process are explained below. At the distant end of arm 31 is handle 45 which is positioned traverse to the direction of extension of corkscrew bracket 30.

Corkscrew mechanism 40 comprises a cap body 42 into which is screwed a male threaded plug 43. The interior surface 48 contains a mating female thread 49 so that male plug 43 is in threaded engagement with interior surface 48. Thumb handle 41 is integral with plug 43 and provides the handle through which the plug is turned. This handle can be as wide as desired to provide easy turning of corkscrew into the cork. As can be seen in the section view of FIG. 2 a corkscrew 44 is mounted into a lower surface 46 of the threaded plug 43. Typically, the screw 44 is glued into plug 43 by conventional binding techniques. It is understood that other means are available to attach the screw 44 into plug 43. Positioned along plug 43 in cap 42 is a non abrasive sleeve 47. Typically, sleeve 47 is made from a plastic material which will prevent scraping and breakage when in contact with the top surface 60 of bottle 28. Contiguous with sleeve 47 are lips 65 and 66 which provide a stop to male plug 43. Plug 43 with its corkscrew 44 is screwed into a cork 63 until plug 43 is stopped by lips 65 and 66. Typically, the plug 43 and corkscrew 44 are dimensioned so that the top of the corkscrew is stopped at approximately the bottom surface 63*a* of cork 63.

In operation, the bottle 28 is placed into the ring portion 25 of the retaining bracket 20 so that the lower neck portion 29*a* of the bottle is contiguous with sleeve 21. In order to facilitate the ease of insertion of bottle 28 into sleeve 21, the retaining bracket is typically moved upward along bracket support 50. When the bottle is then standing upright the retaining bracket is slid downward in a securing position and locked into place by tightening thumbscrew 24. The bottle 28 is thus securely mounted in the device and supported at neck area 29*a* and at bottom area 29*b* by ring 11. Corkscrew bracket 30 is then moved downward until the sleeve 47 rests upon the upper surface 60 of bottle 28. The corkscrew bracket is then locked into position by tightening thumbscrew 35 in mounting bracket 33. Since the sleeve 47 of cap 42 positions the corkscrew mechanism 40 with the top neck portion 29 of the bottle, the corkscrew is positioned above the approximate center point of the cork 63. Thus, the chance of causing bottle or cork breakage as a result of the corkscrew 44 entering cork 63 is minimized. The male plug 43 causes the corkscrew to enter the cork as it is screwed downward. When male plug 43 reaches lips 65 and 66, the corkscrew is properly positioned within the cork 63. The cork is now ready for removal. The operator merely holds handle 45 and moves it up and rearward so that the entire corkscrew bracket rotates about axis pins 34. As the handle 45 is moved upward the corkscrew mechanism maintains an approximate vertical alignment with the cork by swiveling about pin 37. As the handle 45 is moved further, depending upon the size of the bottle, pin 37 moves within slot 39 to compensate for the increasing angle. Thus, a second class lever system is used whereby the weight bearing object, the cork, is positioned between a fulcrum 34 and area of force 45. This systems allows the cork to be removed with a minimum of operator effort.

In a typical embodiment of the present invention, the fulcrum is approximately $1\frac{3}{4}''$ above the point of rotation 37 of the corkscrew mechanism 40. The corkscrew mechanism is approximately $4\frac{3}{4}''$ from the bracket support 50. It has been found that a bracket support 50 of 16" and depth of base 10 of 8" is sufficient to support the entire device. It has also been found that the point of rotation 37 of the corkscrew mechanism 40 is approximately 5" from the handle end of bracket 30. In addition, slot 39 is approximately $\frac{1}{2}''$ long.

I claim:

1. A corked bottle opener (according to claim 1 wherein said cork removing means comprises) comprising a base section, a bracket support means, said bracket support means being in a substantially 90° relationship with said base section, retaining means contiguous with said bracket support means and positioned above said base section so that a bottle is positioned and retained onto said base section, a first bracket portion having a key portion configured to engage said bracket support means, said first bracket portion having means to pivotally engage a second and a third bracket portion, said second bracket portion is integral with said third bracket portion and are in an angular relationship to one another, said third bracket portion confronts said retaining means and further comprises a corkscrew mechanism means pivotally and longitudinally movably mounted to the third bracket portion at a position confronting a slotted cylindrical opening in said retaining means and adapted to engage said cork in the bottle whereby upward movement of said second and third bracket portions pivotally about said first bracket causes the corkscrew mechanism means inserted in said cork to lift the cork out of the bottle.

2. A corked wine bottle opener comprising a base section, a bracket support means, said bracket support means being in a substantially 90° relationship with said base section, retaining means continguous with said bracket support means and positioned above said base section so that a bottle is positioned and retained onto said base section, cork removing means continguous with said bracket support means and positioned above said retaining means, said cork removing means having a first bracket-portion having a key portion configured to engage said bracket support means, said first bracket portion having means to pivotally engage a second and a third bracket portion, said second bracket portion is integral with said third bracket portion and are in an angular relationship to one another, said third bracket portion confronts said retaining means and further comprises a corkscrew mechanism means pivotally and longitudinally movably mounted to the third bracket portion at a position confronting a slotted cylindrical opening in said retaining means and adapted to engage said cork in the bottle, said corkscrew mechanism having a hollow cylindrical cup having female threads along its inner cylindrical surface, a cylindrical plug adapted to fit within said cylindrical cup having male threads on its cylindrical surface in mating alignment with said female threads, said cylindrical plug having a handle integral with its uppermost surface and an elongated corkscrew mounted in its lowermost surface so that a turn of the handle moves said corkscrew downward or upward as the case may be whereby movement of said second and third bracket portions pivotally about said first bracket and in a direction away from said retaining means causes the corkscrew mechanism inserted in said cork to lift the cork out of the bottle.

3. A device for removing a cork plug from the opening of a beverage bottle comprising a base, a bracket intersecting said base having an elongated slot from the uppermost extremity of said bracket to the lowermost extremity, said bracket being continguous with said base at the lowermost extremity, a retaining bracket having a T-shaped portion engaged in said bracket slot and a retaining portion integral with said T-shaped portion, said retaining portion engaging the neck portion of said bottle in a secure cork removal position, a removal bracket having a T-shaped portion engaged in said bracket slot and a second portion pivotally engaged with said T-shaped portion positioned to confront said retaining bracket, a corkscrew mechanism means pivotally and longitudinally movably mounted to said second portion of said removal bracket and positioned to engage said cork in said bottle whereby movement of said second portion of said removal bracket subsequent to the corkscrew mechanism engaging said cork causes said cork to be removed from said bottle.

4. A device for removing a cork plug from the opening of a beverage bottle comprising a base, a bracket intersecting said base having an elongated slot from the uppermost extremity of said bracket to the lowermost extremity, said bracket being continguous with said base at the lower most extremity, a retaining bracket having a T-shaped portion engaged in said bracket slot and a retaining portion integral with said T-shaped portion, said retaining portion engaging the neck portion of said bottle in a secure cork removal position, a removal bracket having a T-shaped portion engaged in said bracket slot and a second portion pivotally engaged with said T-shaped portion positioned to confront said retaining bracket, a corkscrew mechanism pivotally and longitudinally movably mounted to said second portion of said removal bracket and positioned to engage said cork in said bottle, said corkscrew mechanism having a cylindrical housing having a female threaded portion on its inner surface, a cylindrical plug having male threads along its walls positioned within said cylindrical housing and in threaded engagement with said housing, a helical screw positioned transverse to the lower plane surface of said cylindrical plug, and a handle contiguous with the upper plane surface of said cylindrical housing and positioned above the outer surface of said cylindrical housing whereby rotation of said handle causes rotation of said helical screw so that said helical screw engages said cork and subsequent movement of said second portion of said removal bracket subsequent to the corkscrew mechanism engaging said cork causes said cork to be removed from said bottle.

* * * * *